United States Patent [19]

Bartlett et al.

[11] 4,155,483

[45] May 22, 1979

[54] DISPENSING FROM A STERILE ENCLOSURE

[75] Inventors: John R. Bartlett, Monkton Combe; Cedric J. A. Brown, Corston; Raymond H. Phipps, Kingswood, all of England

[73] Assignee: DRG Packaging Limited, Bristol, England

[21] Appl. No.: 759,001

[22] Filed: Jan. 13, 1977

[30] Foreign Application Priority Data

Jan. 21, 1976 [GB] United Kingdom ..... 02374/76

[51] Int. Cl.[2] ..... B67B 7/24

[52] U.S. Cl. ..... 222/1; 222/83.5; 222/88; 221/31

[58] Field of Search ..... 222/83, 83.5, 88, 541, 222/1; 221/30, 31, 32; 206/813

[56] References Cited

U.S. PATENT DOCUMENTS

| | | | |
|---|---|---|---|
| 406,527 | 7/1889 | Meriam | 222/83.5 |
| 2,321,112 | 6/1943 | Tamarin | 221/32 X |
| 3,078,008 | 2/1963 | MacDonald | 221/31 |
| 3,851,762 | 12/1974 | Liblick | 206/813 X |

*Primary Examiner*—Allen N. Knowles
*Assistant Examiner*—Charles A. Marmor
*Attorney, Agent, or Firm*—Larson, Taylor and Hinds

[57] ABSTRACT

A sterile or sterilizable container in which the contents are sealed has a wall provided by a rupturable membrane. Preferably the outer surface of the membrane is covered by a layer of sheet material peelably adhered thereto. To dispense the contents, another rupturable sheet is adhered to the membrane, having first removed the covering layer if present. The surface of said rupturable sheet remote from the membrane is sterile, and a sterile cutting tool is used to cut through the two rupturable layers to create an opening through which the contents can be discharged. The potentially contaminated outer surface of the container membrane is thus sealed to the adjacent surface of the rupturable sheet, which could also be contaminated, thereby minimizing the risk of such contamination being passed to the contents as they are dispensed from the container.

11 Claims, 4 Drawing Figures

12
15
14
17
19

40
42
44
28
46
16
18

14
28
X
40
32
34
16

DISPENSING FROM A STERILE ENCLOSURE

FIELD OF THE INVENTION

This invention relates to dispensing the contents from a sterile enclosure into a sterile environment.

BACKGROUND OF THE INVENTION

A sterile environment is employed in a wide variety of different situations; the principal ones being in medicine and surgery, and in food manufacturing, processing and packaging. It is well known to package an article in an enclosure which is then sterilised. However, normally only the inside of the enclosure will remain sterile, the outside will become contaminated during subsequent handling. The problem therefore is to successfully dispense the article from within the container into a sterile environment without contaminating the article by contact with the outside of the container or by intermediate handling by an operator.

SUMMARY OF THE INVENTION

The foregoing problem can be overcome according to the present invention by the use of a sterile or sterilizable container in which the contents are sealed, a wall of the container being provided by a rupturable membrane. Preferably the outer surface of the membrane is covered by a layer of sheet material peelably adhered thereto. To dispense the contents, another rupturable sheet is adhered to the membrane, having first removed the covering layer if present. The surface of said rupturable sheet remote from the membrane is sterile, and a sterile cutting tool is used to cut through the two rupturable layers to create an opening through which the contents can be discharged. The potentially contaminated outer surface of the container membrane is thus sealed to the adjacent surface of the rupturable sheet, which could also be contaminated, thereby minimising the risk of such contamination being passed to the contents as they are dispensed from the container.

In the context of the present invention the contents of the enclosure could be a sterile liquid, but it is envisaged that the present invention will more usually be applied to solid articles.

BRIEF DESCRIPTION OF THE DRAWINGS AND DESCRIPTION OF PREFERRED EMBODIMENT

In order that the invention may be more clearly understood, one embodiment will now be described with reference to the accompanying drawings, wherein.

Figures 1, 3, 4:
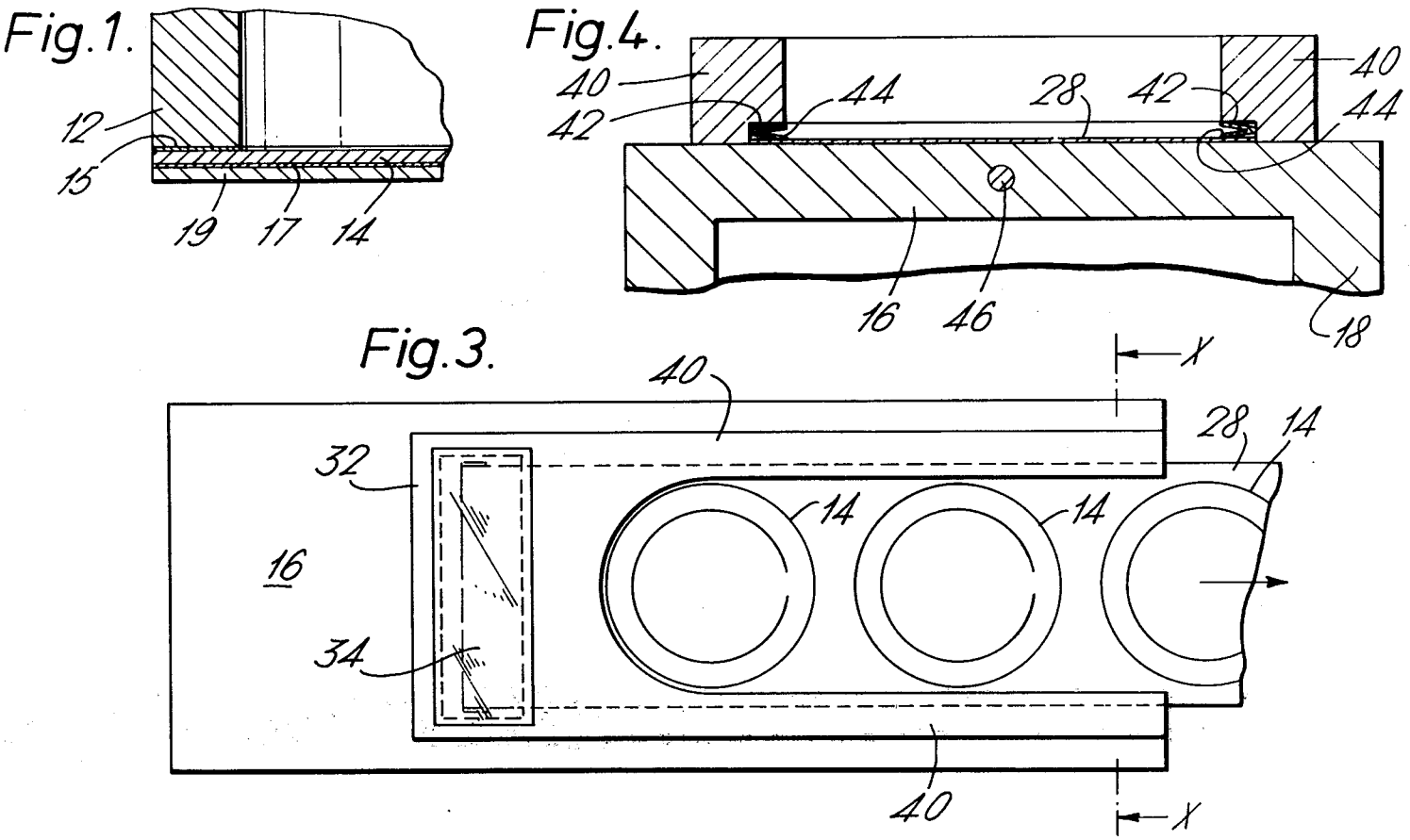
FIG. 1 is an enlarged fragmentary cross-sectional view of the discharge end of a container, with the thickness of the membrane and covering layer exaggerated for clarity.
FIG. 3 shows a plan view of the apparatus with the container removed.
FIG. 4 shows a fragmentary cross-section on the line X—X of FIG. 3.

Referring to the drawings; the contents of the container in this case comprises a stack 10 of nested cups, for example moulded plastics cups, which are to be filled with a foodstuff, such as cream, prior to the sealing of a lidding material over the open top of each cup. The stack of cups is housed in a cylindrical container body 12 which is made of substantially rigid material.

The lower end of the container body is closed by a rupturable membrane 14 peripherally sealed to the container body at 15. The membrane may suitably be made of paper, metal foil, or rupturable Plastic film. Its outer surface is coated with a tacky adhesive substance 17, and until it is desired to remove the stack of cups from the container, the outer surface of the membrane is covered by a protective layer 19, for example of paper, film or foil, which is peelably adhered thereto by the adhesive substance. The interior of the container, including the cups, can be sterilized by normal means, for example by the prior treatment with ethylene oxide or the post-treatment with gamma rays.

Figure 2:
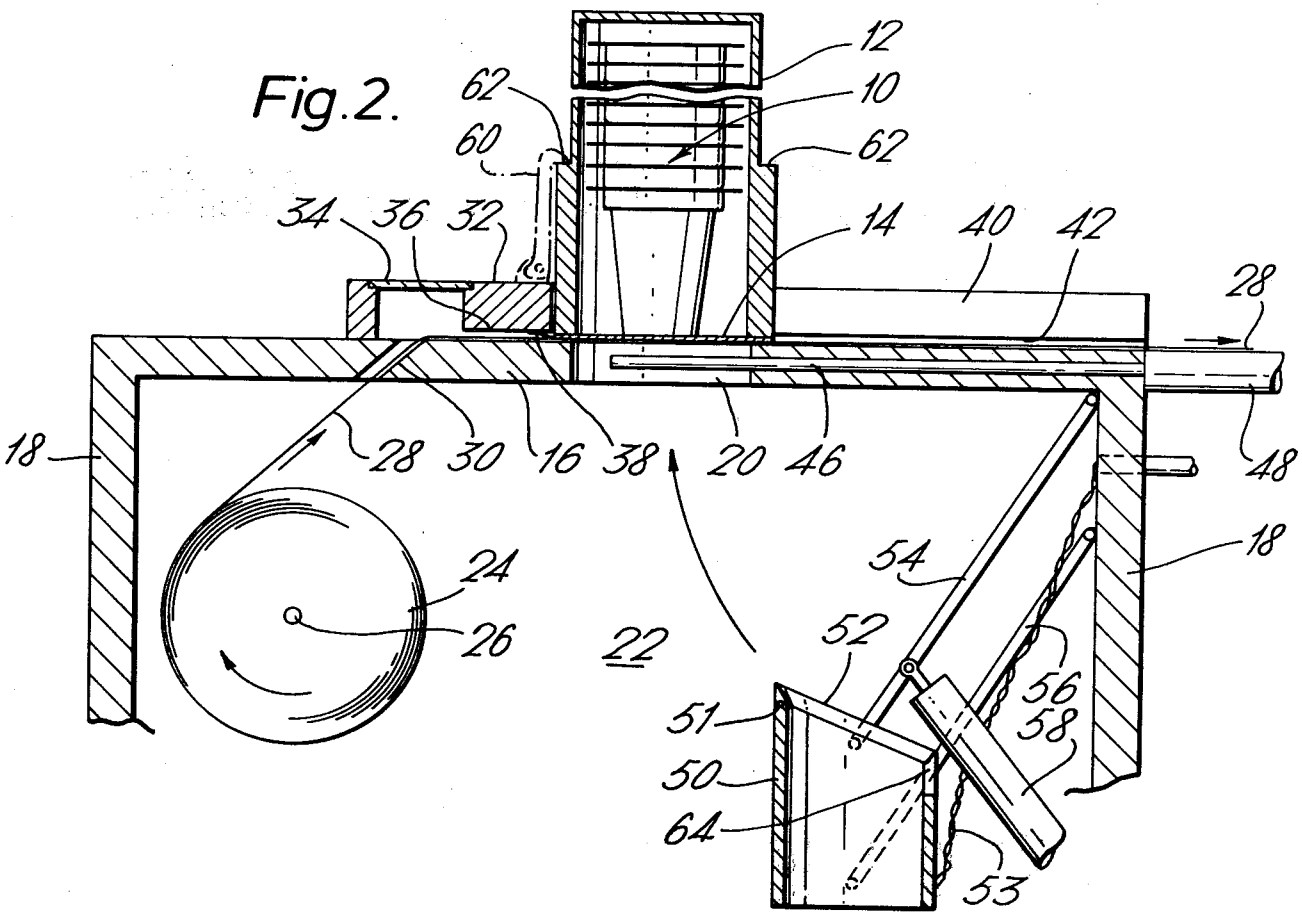
FIG. 2 shows a cross-sectional side view through apparatus of the present invention.

The apparatus for discharging the stack of cups from the container comprises a platform 16 which forms a wall of a general supporting housing 18. The platform has a discharge station comprising a circular opening 20 through which the cups are to be discharged into a sterile environment 22 below the platform. A roll 24 of paper or other rupturable sheet material is pivotally mounted on an axle 26 within the sterile environment. The web 28 of sheet material therefrom is passed through a slot 30 in the platform 16 and taken on top of the platform over the opening 20. A housing extension 32 is mounted to the platform 16 so as to enclose the web 28 where it emerges through the slot 30. A removable window or plate 34 at the top of the housing extension 32 gives access to the interior to facilitate initial threading of the web. The web emerges therefrom through an outlet formed by a narrow slit 36; a resilient strip 38 being provided along the slit to bear down upon the web and press it against the top surface of the platform 16. The housing extension 32 has two parallel limbs 40 which lie over the marginal portions of the web. The limbs 40 are secured to the top of the platform 16, but have recesses 42 to receive the marginal portions of the web. Resilient strips 44 are also located in the recesses 42 to bear upon the marginal portion of the web and press them against the top surface of the platform 16. Thus, the possibility of contamination of the underside of the web in the region of the discharge opening 20 is minimised. A rod 46 is longitudinally slidable below the top surface of the platform 16 so that one end of the rod can be advanced into and retracted from the discharge opening 20. The rod can conveniently be operated by a solenoid 48. A cutting member 50 for the web is of generally cylindrical form, but with an oblique cutting surface 52. The cutting member is pivotally mounted to the housing 18 on a pair of parallel arms 54, 56, so that the axis of the cylindrical cutting member is at all times vertical. A hydraulic or pneumatic ram 58 acts between the housing 18 and the parallel arms to advance and retract the cutting member between a retracted position as shown in FIG. 2 and an advanced position in which the cutting edge 52 passes up through the discharge opening 20 and ruptures the web 28.

In use, the protective covering layer 19 is removed from the membrane 14 of a sealed container 12, and the container is then located on the platform 16 over the discharge opening 20 so that the adhesive surface of the membrane 14 is face to face with the web sheet material 28. The container is secured in position by a suitable means, for example by means of catches 60 mounted on the housing extension 32 which hook over an annular shoulder 62 on the container 12. The rod 46 is in the advanced condition, as shown, in which it extends into the discharge opening 20. At a suitable moment, the ram 58 is operated, causing the cutting member 50 to rise into the discharge opening 20. The oblique cutting edge 52 cuts progressively through the cohered sheet material 28 and membrane 14. The cutting edge 52 does not form a complete circle, but is interrupted by a slot 64. This slot forms a dual function. Firstly it accommodates the rod 46, and secondly it leaves a neck of uncut material which joins the cut disc of sheet material with the rest of the web 28, as can be seen in FIG. 3. Thus, the cut material does not fall down into the sterile enviroment 22, but remains attached to the web. Immediately after cutting, the cutting member is withdrawn, the stack 10 of cups being temporarily supported on the rod 46, which is then retracted at a suitable moment to allow the stack to fall through the cut in the sheet 28 and membrane 14 into the sterile environment, where they are denested, filled and closed by conventional machinery. The empty container 12 can then be removed and replaced by a fresh container, in the manner described. Before locating a fresh container, however, the web 28 is advanced so as to present an unruptured portion thereof over the discharge opening 20. As can be seen in FIG. 3, the cut discs of sheet material and membrane, being still attached to the web 28, are taken with the web as it is advanced from the discharge station.

The foregoing embodiment illustrates in a simple form how the invention can be carried out. It may be modified in many different ways to suit different applications. Cream or similar foodstuffs are usually automatically packed in cups or the like containers within an enclosed machine which provides a sterile environment. In such a situation, the apparatus illustrated would be mounted to the top of the machine in the region where the cups would normally be inserted. The area 22 within the housing 18 would therefore become an extension of the sterile environment of the machine, whereas the area outside the housing 18 will be the normal room environment in which the machine is operated. Thus, the upper surface of the web 28 which is exposed between the limbs 40 could well become contaminated, and similarly the adhesive surface of the membrane 14 which is exposed when its protective covering layer is removed could become somewhat contaminated during the short period before the container is located in position over the discharge opening. However, the two contaminated surfaces are adhered together, and the adhesion is reinforced by the pressure from the cutting edge 52 during the cutting operation, so that the sheet and membrane are securely adhered around the cut edge and there is minimal risk of contamination from between the two materials. Thus, while the container is in position, its interior becomes an extension of the sterile environment 22. The cutting device 50, and particularly its cutting edge 52, could be heated, for example by an electrical heating element 51 in the cutting edge portion supplied with current through wires 53, so that in the event of using a heat sealable material as membrane and movable sheet, the two layers could be heat sealed together around the cut as the cut is made. Sufficient heat may also help towards sterility of the cut edge. Means may be provided for automatically advancing the web as the catches 60 are released so that a fresh area of web is moved over the discharge opening 20 before the container is lifted to any substantial extent, and therefore before any appreciable contamination could occur through the opening in the web. If desired, the reel 24 could be presented to the apparatus in a magazine or container previously sterilised so as to reduce sterilization procedures during start up. Instead of mounting and dismounting the containers 12 individually, as described, a number of containers could be mounted to a magazine, for example to a rotating drum, which could be arranged to be indexed so that each container is located in turn over the discharge opening. Instead of actuating the rod 46 separately by means of solenoid 48 or other suitable means, the movement of the rod could be linked to the movement of the cutting member, so that the rod is advanced into the opening 20 as the cutting member starts its upward movement, and is withdrawn as the cutting member reaches the retracted position once more. The use of a large roll 24 of sheet material enables a sufficient quantity of the sheet material to be installed for a long period of operation, for example one day, thus avoiding frequent repeated sterilisation procedures, which may be necessary whenever a new roll is inserted.

Instead of discharging a stack of cups, each container may house only a single cup, but obviously this is likely to be less economical for mass production purposes. However, the invention may be used in other situations, for example in medicine and surgery, for the purpose of discharging sterile materials and equipment from the container into the sterile surgical environment. Apparatus such as that illustrated could be suitably modified for this purpose. The housing 18 could be replaced by supporting legs for the platform 16, and instead of a cylindrical container 12, the top of the platform could be adapted to support other forms of containers appropriate to medical materials and equipment. In such circumstances, the container would be simply placed on the platform over the discharge opening 20, and the cutting member operated to rupture the cohered membranes and sheet material and discharge the contents of the container into the sterile environment. Equipment of this sort could be mounted to the wall of an operating theatre, for example, to enable sterile equipment to be introduced into the operating theatre without having to sterilise the entire package beforehand, and without having to break open the packages within the theatre.

We claim:

1. A method of discharging into a sterile environment contents from a sealed container having a wall which is provided by a rupturable membrane; the method comprising the steps of:

(i) adhering the exposed surface of the rupturable membrane face to face with a sheet of rupturable material which sheet forms a boundary to a sterile environment, (ii) rupturing the adhered membrane and sheet, and (iii) discharging the contents through the cut thus formed.

2. A method according to claim 1, in which the exposed surface of the membrane is adhesive, whereby it is adhered to the sheet material in step (i) by placing membrane and sheet in contact.

3. A method according to claim 2 wherein a covering layer is peelably adhered to the membrane initially, the method including the initial step of removing the covering layer from the membrane prior to step (i).

4. A method according to claim 1 wherein the membrane and sheet are of heat-sealable material and are ruptured in step (ii) by the application of a heated cutting member which heat-seals the membrane and sheet together around the edge of the cut thus formed.

5. Apparatus for discharging into a sterile environment sterile components from a sealed container having a wall which is provided by a rupturable membrane; the apparatus comprising a supporting structure which includes a discharge station for said contents and means for supporting a sheet of rupturable material at the discharge station so that one surface of the sheet is presented to an environment into which said contents are to be discharged, and means for supporting a said container at the discharge station so that the outer surface of said membrane is face to face with the sheet of rupturable material, a layer of adhesive material disposed between said outer surface of said membrane and said sheet of rupturable material for adhering said sheet material and membrane, and a cutting member mounted to the supporting structure and for cutting a sheet and adhered membrane at the discharge station whereby said contents may be discharged from the container into said environment through the cut thus formed.

6. Apparatus according to claim 5, wherein the cutting member has a cutting edge defining the cut to be formed, and moves against the sheet material from the side of said environment.

7. Apparatus according to claim 6 wherein the cutting edge does not define a complete area to be cut, whereby a cut sheet material and adhered membrane remain connected to the remainder of the sheet after discharge of the contents.

8. Apparatus according to claim 5 wherein the sheet material takes the form of a web, means being provided for mounting a store of the web material to the supporting structure so that the web can be drawn therefrom and incrementally advanced over the discharge station between successive discharge operations.

9. Apparatus according to claim 5 wherein the supporting structure has mounted to it means for temporarily supporting said contents at the discharge station during cutting of the sheet and membrane, the contents support means being movable to allow discharge of the contents after the cutting operation.

10. Apparatus according to claim 5 wherein said supporting structure takes the form of a housing the interior of which forms at least part of said environment into which said contents are to be discharged, a wall of the housing having an opening at said discharge station through which the contents are to be discharged, means for mounting within the housing a store of said sheet material in the form of a web, an outlet in the housing through which the web can be drawn so as to cover said opening, and sealing elements bearing upon the surface of the web at said outlet and in the region of said opening so as to substantially prevent the entry of contamination into the housing through the outlet and opening.

11. Apparatus according to claim 5 wherein the cutting member includes heating means so that the membrane and sheet, if made of heat-sealable material, can be heat-sealed together around the edge of the cut made by the cutting member.

* * * * *